US009018840B2

(12) United States Patent
Hickok et al.

(10) Patent No.: US 9,018,840 B2
(45) Date of Patent: Apr. 28, 2015

(54) SYSTEMS AND METHODS FOR PROVIDING A LIGHTING EFFECT

(71) Applicant: ABL IP Holding LLC, Conyers, GA (US)

(72) Inventors: John T. Hickok, Social Circle, GA (US); Mark Norton, Covington, GA (US); Richard L. Westrick, Jr., Social Circle, GA (US)

(73) Assignee: ABL IP Holding LLC, Conyers, GA (US)

( * ) Notice: Subject to any disclaimer, the term of this patent is extended or adjusted under 35 U.S.C. 154(b) by 12 days.

(21) Appl. No.: 13/832,980

(22) Filed: Mar. 15, 2013

(65) Prior Publication Data

US 2014/0265864 A1 Sep. 18, 2014

(51) Int. Cl.
*H05B 37/02* (2006.01)

(52) U.S. Cl.
CPC ..... *H05B 37/02* (2013.01)

(58) Field of Classification Search
USPC ..... 315/132
See application file for complete search history.

(56) References Cited

U.S. PATENT DOCUMENTS 7,139,617 B1 11/2006 Morgan et al.
7,186,003 B2 3/2007 Dowling et al.
7,353,071 B2 * 4/2008 Blackwell et al. ..... 700/23
7,358,961 B2 4/2008 Zwanenburg
7,502,034 B2 3/2009 Chemel et al.
2012/0081010 A1 * 4/2012 Hatley et al. ..... 315/149
2012/0169238 A1 * 7/2012 Lenderink ..... 315/151

FOREIGN PATENT DOCUMENTS

WO WO 2013011405 A1 * 1/2013

OTHER PUBLICATIONS

Light System Manager User Guide, 2009, Philips, pp. 48, 52, 56.*
Light: visible spectrum, 2006, Encyclopedia Britannica, 1.*
Philips Color Kinetics, ColorDial Pro, Product Guide, R02, May 2012.

* cited by examiner

*Primary Examiner* — Don Le
*Assistant Examiner* — Tanina Bradley
(74) *Attorney, Agent, or Firm* — Kilpatrick Townsend & Stockton, LLP

(57) ABSTRACT

Systems and methods for creating and previewing a lighting effect, such as displaying an array of colors across a number of lighting fixtures are provided. A user may specify some of the colors for the array, as well as relative positions of the colors. A lighting management system determines transitional or intermediary colors and assigns the colors specified by the user, as well as the intermediary colors to the lighting fixtures. The resulting lighting effect may be displayed in a preview bar. The colors and the order of the colors may be edited to obtain a desired lighting effect.

15 Claims, 5 Drawing Sheets

SYSTEMS AND METHODS FOR PROVIDING A LIGHTING EFFECT

FIELD OF THE INVENTION

The present invention is directed to defining colors for lighting fixtures and in particular to displaying an array of colors across multiple lighting fixtures.

BACKGROUND

Conventional lighting systems allow a user to define colors for lighting fixtures one fixture at a time. If the user wants to display an array of colors, such as the colors in a rainbow, across the lighting fixtures, then the user must define each color that will be displayed and assign each lighting fixture one of the defined colors. Depending upon the number of lighting fixtures and the colors that the user selects, the process can be fairly tedious. In the case of an array that follows a known color order, such as a rainbow, it would be simpler if the user could define a starting color and an ending color and have the lighting controller determine the intermediate colors and determine which colors to assign to which fixtures.

SUMMARY

Aspects of the invention provide systems and methods for creating and previewing a lighting effect, such as displaying an array of colors across a number of lighting fixtures. In one aspect, a lighting management system is provided. The system includes a controller for controlling a number of lighting fixtures. The controller may receive colors and the order of the colors and determine how to assign the colors across the lighting fixtures. In addition, the controller may determine intermediary colors for display by lighting fixtures located between the lighting fixtures that display the received colors. The intermediary colors provide color transitions between the received colors.

In another aspect a preview bar is provided that previews the lighting effect. The preview bar may include a number of steps. Some of the steps are associated with the ordered list of colors and some of the steps are associated with the intermediary colors. A user may edit the lighting effect by changing the colors or the order of the colors and the preview bar will reflect the changes.

These and other aspects, features and advantages of the present invention may be more clearly understood and appreciated from a review of the following detailed description and by reference to the appended drawings and claims.

DETAILED DESCRIPTION

Certain aspects of the present invention disclose systems and methods for providing a lighting effect, such as displaying an array of colors across a number of lighting fixtures. A user may specify some of the colors for the array, as well as relative positions of the colors. The lighting management system determines intermediary colors and assigns the colors specified by the user, as well as the intermediary colors to the lighting fixtures. The resulting lighting effect may be displayed in a preview bar. The user can edit the colors and the order of the colors to obtain a desired lighting effect.

Lighting Management System

Figure 1:
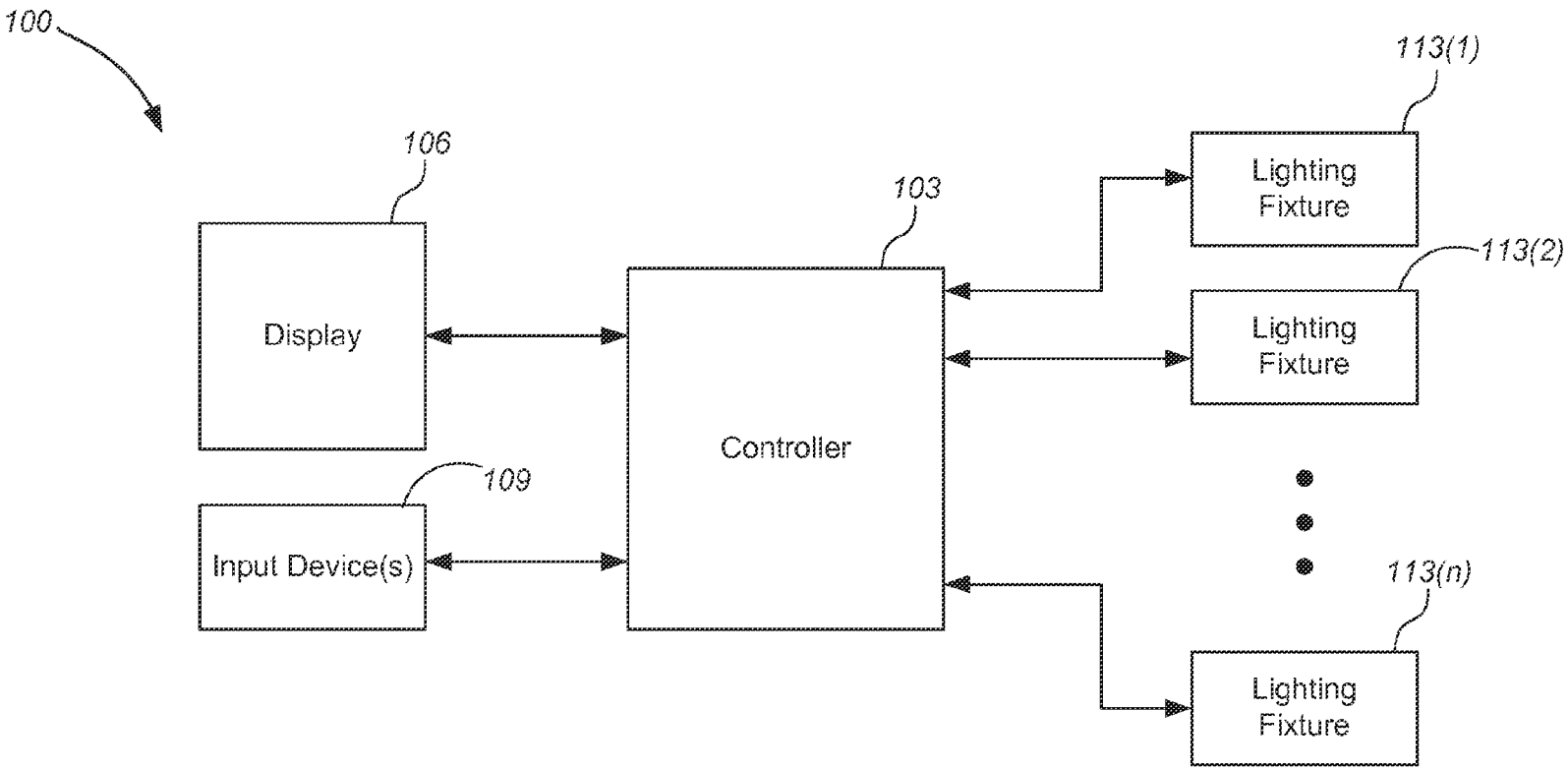
FIG. 1 is a block diagram illustrating an example of a lighting management system.

FIG. 1 shows a lighting management system 100 that includes a lighting controller 103, a display 106, one or more input devices 109, and a number of lighting fixtures 113(1)-113(n). In one embodiment, the controller 103 manages one or more light shows for the lighting fixtures 113(1)-113(n). For example, a user may provide inputs related to the lighting states for a light show via the input devices 109 or via a user interface rendered on a touchscreen display 106. The controller 103 receives the inputs and generates the appropriate control signals to control the lighting fixtures 113(1)-113(n). The control signals may control color, intensity, position, and/or other types of attributes. Additionally, the user may specify attributes for a portion or all of the lighting fixtures 113(1)-113(n).

In one implementation, the controller 103 is embodied as an application or other software module residing in a memory of a device that executes the application. For example, the application may reside in a computer-readable medium and execute on a suitable processor. Such a processor may comprise a microprocessor, an ASIC, a state machine, or other processor, and can be any of a number of computer processors. Additionally, the processor may be in communication with the computer-readable medium which stores instructions and other components such that when executed by the processor, cause the processor to perform the steps and methods described herein. The computer-readable medium may include an electronic, optical, magnetic, or other storage device capable of providing the processor with computer-readable instructions. Other examples include a floppy disk, CR-ROM, DVD, magnetic disc, memory chip, ROM, RAM, optical storage, magnetic tape or other media from which a computer processor can read instructions and/or access information. Further, the instructions stored on the computer-readable medium may include processor-specific instructions generated by a compiler and/or an interpreter from code written in any suitable computer-programming language, including for example, C, C++, C#, Visual Basic, Java, Python, Perl, JavaScript, and ActionScript.

The lighting fixtures 113(1)-113(n) may be any type of lighting fixtures, including, but not limited to, those that use tungsten-halogen lamps, LEDs, Organic LEDs, or fluorescent lamps. There may be a mixture of different types of lighting fixtures within the same lighting management system. These fixtures may be controlled by either digital signals, analog signals, power modulation, or a combination thereof. The lighting controller 103 maintains information on the lighting fixtures so that it knows the position and type of each lighting fixture.

The lighting controller provides a user interface that allows a user to control attributes of selected lighting fixtures to create lighting states and light shows. The user interface may support high level functions that allow the user to control the lighting fixtures by selecting certain lighting effects or entering certain commands that the lighting controller translates into control signals for the lighting fixtures.

Creating a Color Array

The user interface may support an option for creating a color array, such as a rainbow, across a number of lighting fixtures. If so, then the user interface shown in FIG. 2 may be rendered on the display 106. The user interface includes a preview bar 206, a configuration panel 203 that allows the user to input an ordered list of colors, an auto-rainbow button 206, a color button 209, a shift up button 213, a shift down button 216, a mirror button 219, an insert button 224, and a delete button 226. The user interface may include other types of buttons as well, including those shown in panel 233. The user interface of FIG. 2 allows the user to edit a lighting state, such as, for example, by selecting colors, adjusting the colors, adjusting the sequence of the colors, adding colors, deleting color, creating a rainbow effect or creating a mirror effect.

Figure 2:
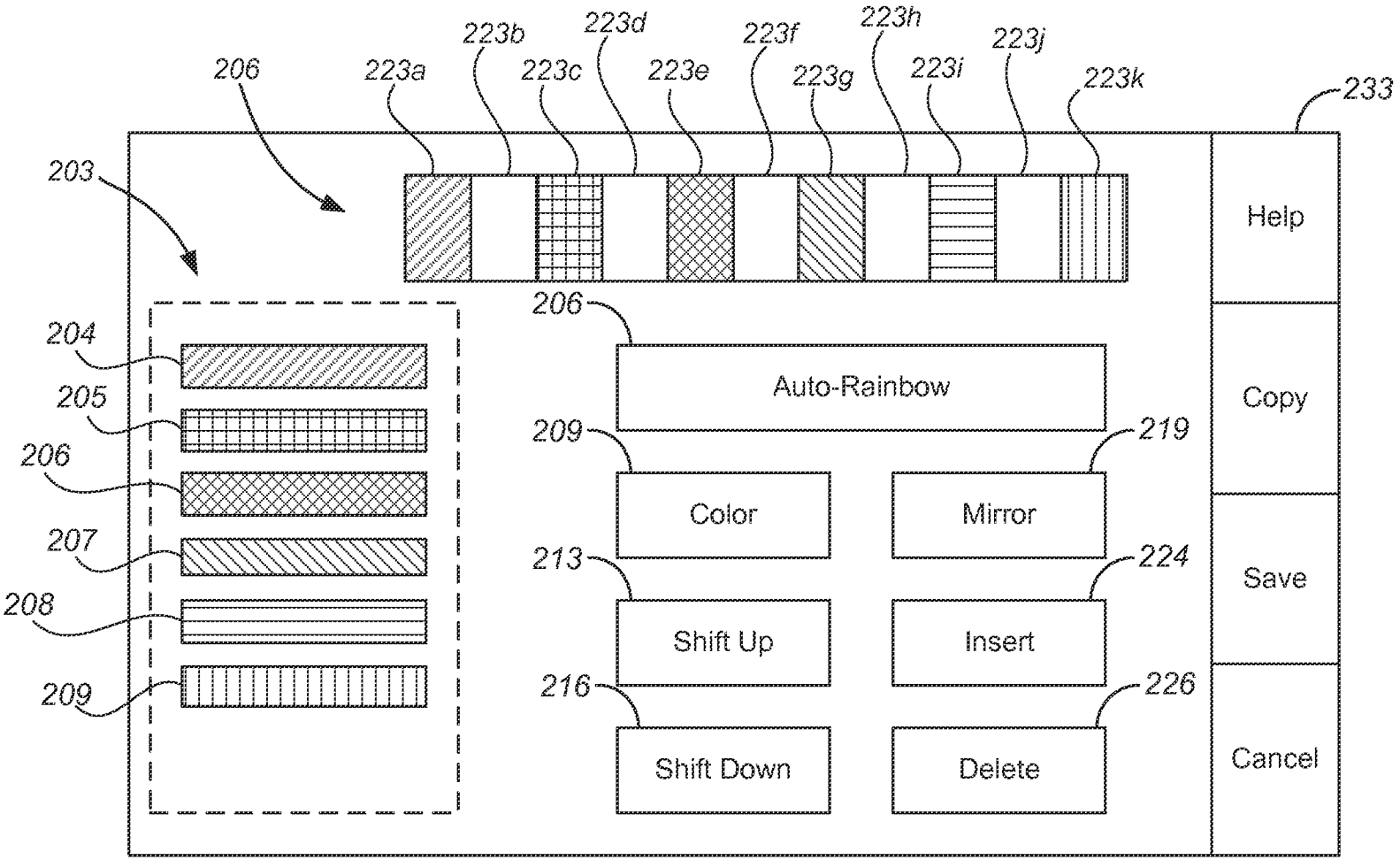
FIG. 2 is an illustration of an example user interface rendered on a display device for creating a lighting state that includes an array of colors to be displayed by a number of lighting fixtures.

Although not shown in FIG. 2, the user may select the lighting fixtures that will display the color array. The user may select individual lighting fixtures or may select predefined groups of lighting fixtures via the user interface.

The configuration panel 203 of FIG. 2 depicts the user's selection of six colors 204-209 and the user's ordering of the colors from a first position to a last position. In one implementation, the user interface may present the user with a number of colors in response to the user selecting the color button 209. The user may then select the colors for the list from the displayed colors. The user may arrange the selected colors in an order by selecting the colors in a particular order and/or by using the shift up button 213 or the shift down button 216. The user may also edit the selected colors by using the insert button 224 or the delete button 226.

FIG. 2 shows that the ordered list of colors includes color 204 as the first color, color 205 as the second color, color 206 as the third color, color 207 as the fourth color, color 208 as the fifth color, and color 209 as the sixth or last color. The display includes a preview bar 206 with 11 steps 223*a*-223*k*. In one implementation each step in the preview bar corresponds to a lighting fixture. In other implementations each step in the preview bar corresponds to a set of lighting fixtures that are located proximate to one another. The first step 223*a* in the preview bar is associated with the first color 204. The last step 223*k* in the preview bar is associated with the sixth or last color 209. The remaining user-selected colors are distributed evenly between the first step and the last step. The second color 205 is associated with the third step 223*c*, the third color 206 is associated with the fifth step 223*e*, the fourth color 207 is associated with the seventh step 223*g*, and the fifth color 208 is associated with the ninth step 223*i*.

Figure 3:
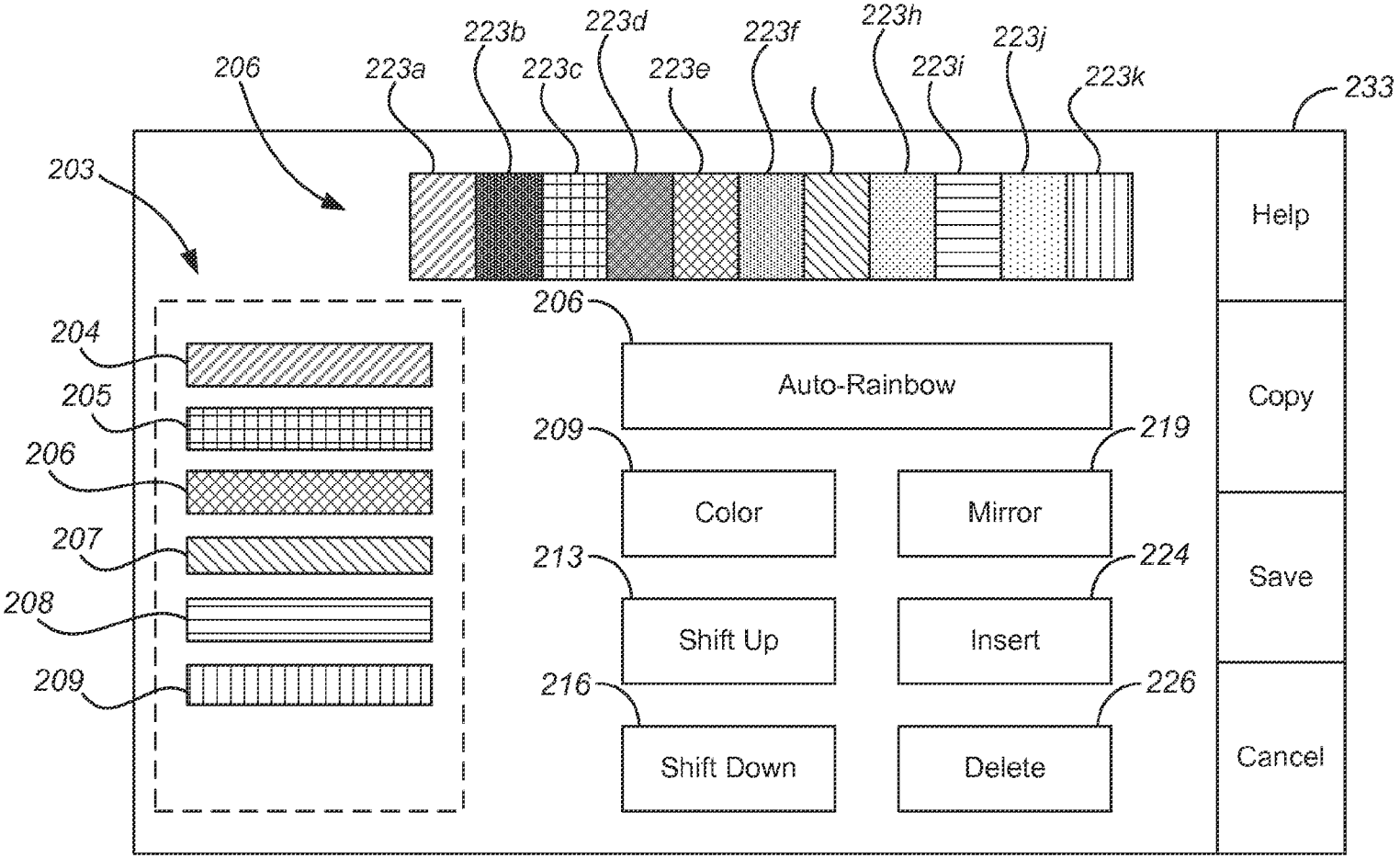
FIG. 3 is another illustration of an example user interface rendered on the display device for creating a lighting state that includes an array of colors to be displayed by a number of lighting fixtures.

Since the user has selected the rainbow option, the lighting controller determines transitional colors for the steps between the steps associated with the user-selected colors. These colors are referred to herein as intermediary colors. FIG. 3 illustrates the result of inserting the intermediary colors into the preview bar. Intermediary colors are associated with the steps in the preview bar 206 that fall between the steps associated with the user-selected colors. An intermediary color is based on the colors in the adjacent steps. For example, the intermediary color for step 223*b* is based on the first color 204 and the second color 205 and the intermediary color for step 223*d* is based on the second color 205 and the third color 206. In one implementation, the lighting controller determines the intermediary color by calculating a path through the color space from the first color 204 to the second color 205 and selects a color that is approximately halfway between the two colors along the path. In another implementation, the lighting controller averages the frequencies or wavelengths associated with the first color 204 and the second color 205 to determine the intermediary color.

If there is more than one step between the steps associated with user-selected colors, then the lighting controller will determine intermediary colors for each of the steps between the steps with user-selected colors. The intermediary colors may be different colors along the path through the color space between the two user-selected colors. Typically, the intermediary colors are selected so that they are approximately evenly distributed along the path between the two user-selected colors. Alternatively, the intermediary colors may be determined by selecting frequencies or wavelengths between the two user-selected colors that are evenly spaced between the two.

The lighting controller determines the control signals needed for each of the lighting fixtures to produce the colors shown in the preview bar. The lighting controller associates the lighting fixtures with the steps so that the colors are displayed by the lighting fixtures in the order shown on the preview bar. For example, if there is one lighting fixture associated with each step, then the color associated with the first step 223*a* may be displayed by a first lighting fixture directed to the left-hand side of the stage when viewed from the audience's perspective and the color associated with the last step 223*k* may be displayed by a last lighting fixture directed to the right-hand side of the stage when viewed from the audience's perspective. The colors between the first step and the last step may be displayed by other lighting fixtures located between the first lighting fixture and the last lighting fixture so that the colors are displayed by the lighting fixtures in the order shown in the preview bar.

The colors may be displayed by the lighting fixtures at approximately the same time or the user may indicate that the colors are to be displayed sequentially so that the first lighting fixture displays the first color, which transitions off as the second lighting fixture begins to display the second color, etc. The lighting state may be saved and/or incorporated with other lighting states to create a light show.

Although FIG. 2 illustrates one display showing the user-selected colors assigned to steps and FIG. 3 illustrates another display showing the user-selected colors and the intermediary colors assigned to steps, both displays may not be used in all implementations. Instead, there may be another button that the user selects, such as a preview button, that triggers the display of both user-selected and intermediary colors in the preview bar or the preview bar may dynamically adjusted as the user enters colors and orders the colors in the configuration panel.

The number of colors selected by the user does not need to equal the number of lighting fixtures selected since the lighting controller will determine intermediary colors as needed. The maximum number of steps in the preview bar is limited by the number of lighting fixtures selected by the user.

For purposes of illustration the figures show that there is a clear demarcation between adjacent steps. However, in some instances the colors will not be displayed as separate colors, but will gradually transition or fade between user-selected colors.

Creating a Rainbow Effect

The auto-rainbow function automatically generates a rainbow across all of the controlled or selected lighting fixtures using the appropriate color space. In one implementation the colors span the visible RGB spectrum. To use the auto-rainbow function, the user may optionally select a set of lighting fixtures, if the user does not want the rainbow effect to apply to all of the controlled lighting fixtures, and then selects the auto-rainbow button. The lighting controller determines the colors for each of the fixtures based, in part, on the number of fixtures. The color for the first fixture is associated with a color at approximately one end of the visible spectrum and the color for the last fixture is associated with a color at approximately the other end of the visible spectrum. Intermediary colors are determined for the remaining fixtures so that colors of the spectrum are evenly distributed across the selected lighting fixtures.

Creating a Mirror Effect

Figure 4:
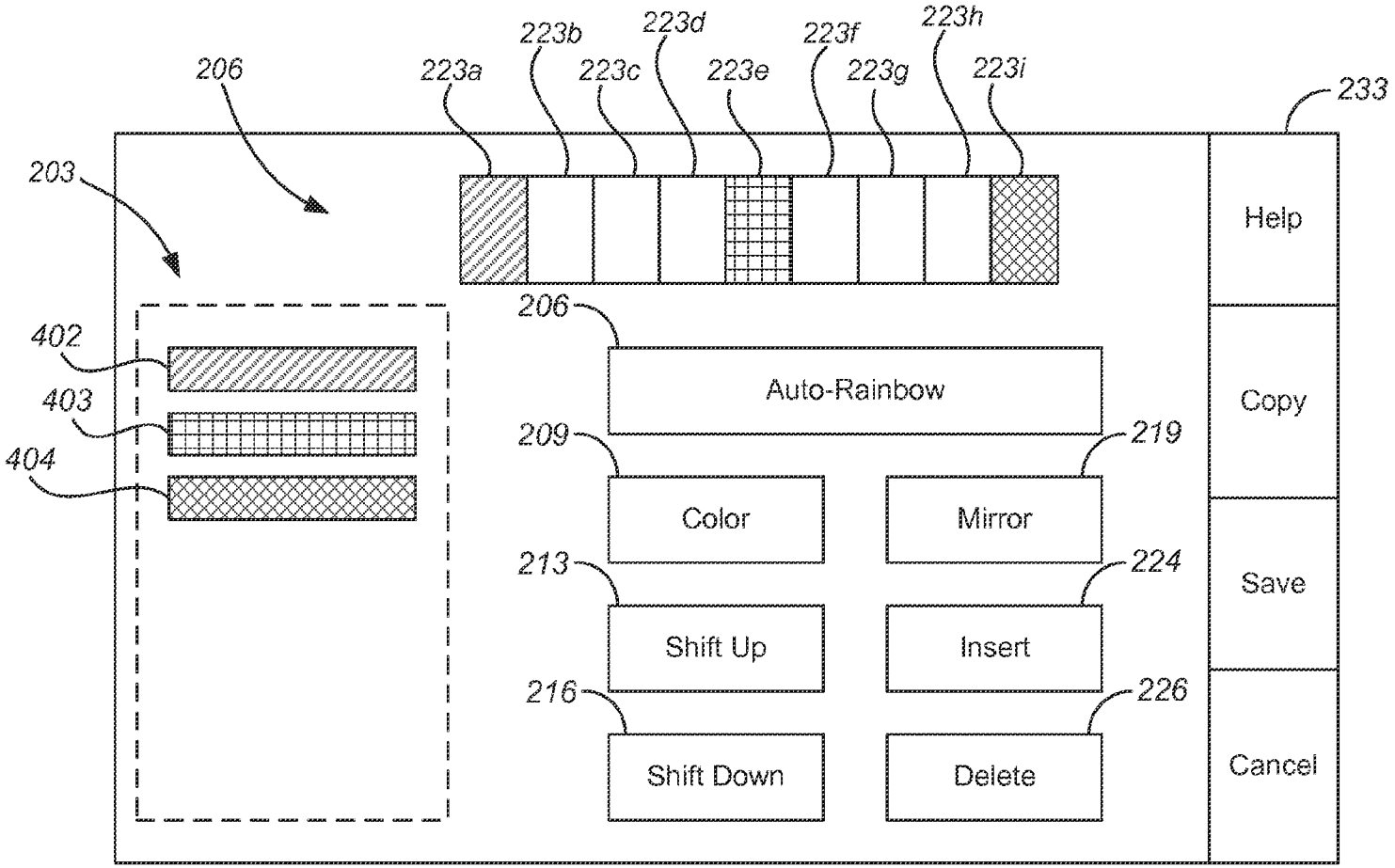
FIG. 4 is another illustration of an example user interface rendered on the display device for creating a lighting state that includes an array of colors to be displayed by a number of lighting fixtures.

FIG. 4 illustrates another example of a user interface rendered on the display 106. In this example, the user has selected nine fixtures or nine sets of fixtures and has selected three light show colors, color 402, color 403, and color 404, as shown in the configuration panel 203. For simplicity, the following description assumes that there is one lighting fixture per step. After the user enters the three colors, the lighting controller 103 distributes the three colors evenly across the preview bar. In this example, the steps that are not associated with the user-selected colors are not shaded. Note that in any of the examples provided herein the lighting controller may allow the user to preview the lighting effect without displaying it on the lighting fixtures. Alternatively, the lighting effect may be displayed by the selected lighting fixtures as the user creates or edits the lighting state. If the lighting effect is displayed, then it is displayed by the selected lighting fixtures, as depicted in the preview bar 206. For example, the first color 402 associated with the first step 223*a* may be displayed by the first lighting fixture, the second color 403 associated with the step at approximately the midpoint of the preview bar 223*e* may be displayed by a lighting fixture at approximately the midpoint of the set of lighting fixtures, and the last color 404 associated with the last step of the preview bar 223*i* may be displayed by the last lighting fixture.

The lighting controller also determines the intermediary colors for the steps 223*b*, 223*c*, 223*d*, 223*f*, 223*g*, 223*h* between the steps associated with the user-selected colors. In this example, there are three steps between each of the steps associated with user-selected colors. In one implementation, the lighting controller determines a path through the color space from a point corresponding to the first color 402 to a point corresponding to the second color 403 and selects three points along the path that are spaced approximately evenly between the end points. The colors associated with the three points are the intermediary colors for steps 223*b*, 223*c*, and 223*d*. The lighting controller uses a similar approach to determine the intermediary colors for steps 223*f*, 223*g*, 223*h*, using the second color and the third color as the end points.

Figure 5:
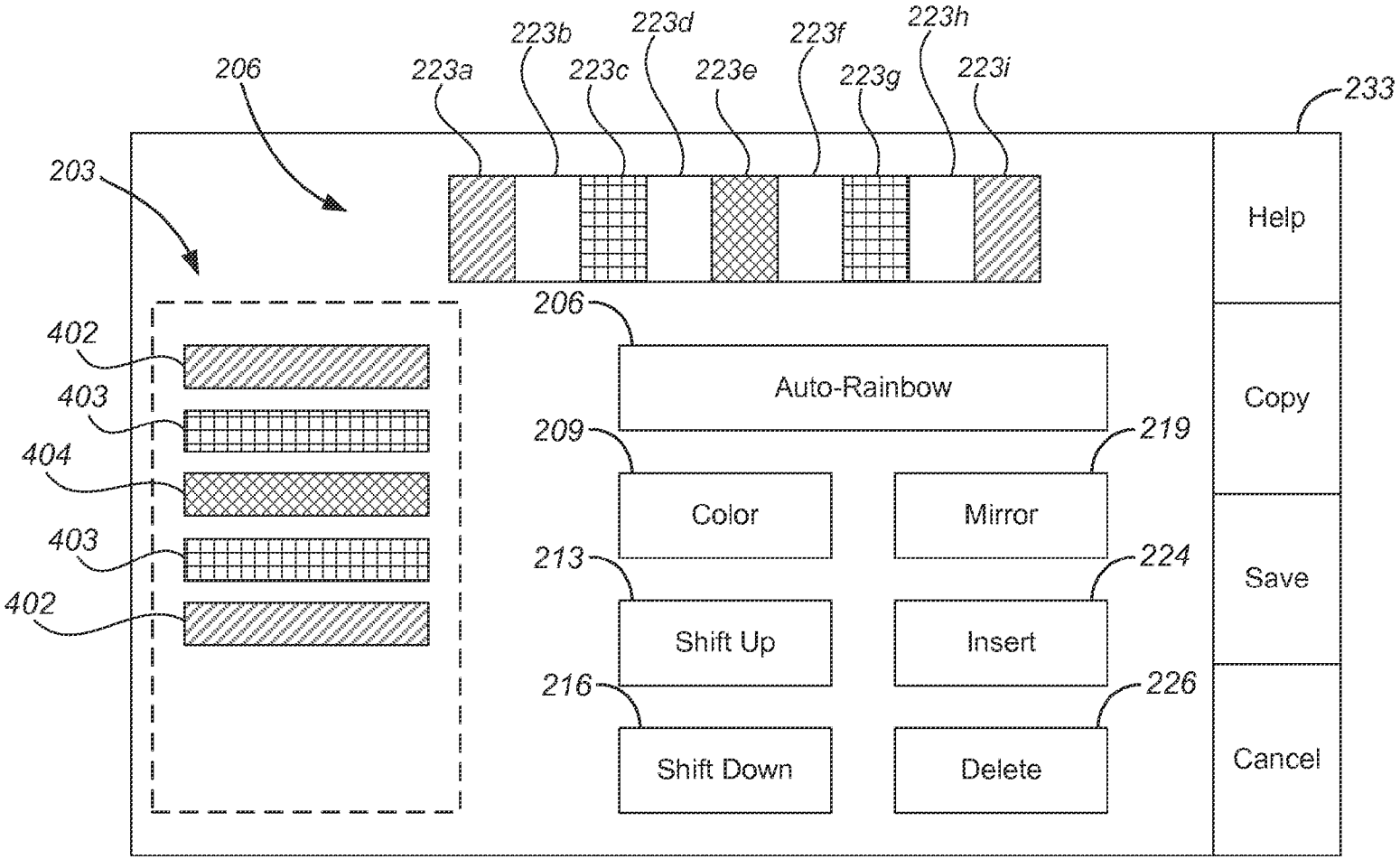
FIG. 5 is another illustration of an example user interface rendered on the display device for creating a lighting state that includes an array of colors to be displayed by a number of lighting fixtures.

If the user invokes the mirror button 219, then the lighting controller implements a mirror effect, as illustrated in FIG. 5. The lighting controller modifies the list of colors 203 to add two additional color items. Color 403 is repeated after color 404 and color 402 is repeated after the second occurrence of color 403. The lighting controller also modifies the preview bar so that the colors are symmetric around what was previously the last color 404. As shown in FIG. 5, the preview bar 206 depicts that the first color 402 is associated with the first step 223*a* and the last step 223*i*, the second color 403 is associated with steps 223*c* and 223*g*, and the last color 404 is associated with the step at the midpoint 223*e* of the preview bar. The number of steps in the preview bar of FIG. 4 is the same as the number of steps in the preview bar of FIG. 5, but since there are more steps associated with user-selected colors in the preview bar of FIG. 5 there are fewer steps associated with intermediary colors. The mirror effect results in a symmetric display around the color at the midpoint step so the intermediary color associated with step 223*b* is the same as the intermediary color associated with step 223*h* and the intermediary color associated with step 223*d* is the same as the intermediary color associated with 223*f*.

The foregoing is provided for purposes of illustrating, describing, and explaining aspects of the present invention and is not intended to be exhaustive or to limit the invention to the precise forms disclosed. Further modifications and adaptation of these embodiments will be apparent to those skilled in the art and may be made without departing form the scope and spirit of the invention. Different arrangements of the components depicted in the drawings or described above, as well as components and steps not shown or described are possible. Similarly, some features and subcombinations are useful and may be employed without reference to other features and subcombinations. Embodiments of the invention have been described for illustrative and not restrictive purposes, and alternative embodiments will become apparent to readers of this patent. For example, the physical layout of the displays and the ways of inputting colors may differ from those described herein.

We claim:

1. A method for creating a lighting state for a plurality of lighting fixtures, comprising:

receiving, via one or more input devices, an ordered list of colors, wherein the ordered list of colors includes a first color and a last color;

defining, via a controller, a plurality of steps wherein each step corresponds to one of the plurality of lighting fixtures, wherein the steps include a first step and a last step, the first step is associated with the first color and the last step is associated with the last color, and the first step is associated with a lighting fixture at a first location and the last step is associated with a lighting fixture at a last location;

determining, via the controller, intermediary colors for steps between the first step and the last step, wherein the intermediary colors are determined by defining a path from the first color to the last color through a color space and selecting colors along the path that are approximately equally spaced along the path as the intermediary colors;

assigning, via the controller, the intermediary colors for the steps between the first step and the last step so that a progression of the intermediary colors in a direction from the first step to the last step follows a progression of the colors along the path from the first color to the last color;

receiving, via the one or more input devices, a selection of a mirror function; and redefining, by the controller, the steps so that a midpoint step is approximately halfway between the first step and the last step and is associated with the last color and the last step is associated with the first color, colors associated with steps between the first step and the midpoint step mirror colors associated with steps between the midpoint step and the last step, and the midpoint step is associated with a lighting fixture at a midpoint location that is approximately halfway between the lighting fixture at the first location and the lighting fixture at the last location.

2. The method of claim 1, further comprising:

prior to receiving the selection of the mirror function, providing, via a display device, a preview bar showing the first step with the first color, the last step with the last color and the steps between the first step and the last step with the intermediary colors.

3. The method of claim 1, further comprising:

prior to receiving the selection of the mirror function, providing, via the controller, control signals to the lighting fixtures so that the lighting fixture at the first location displays the first color, the lighting fixture at the last location displays the last color, and lighting fixtures at locations between the first location and the last location display the intermediary colors.

4. The method of claim 1, wherein receiving, via one or more input devices, an ordered list of colors, further comprises:

receiving, via the one or more input devices, a midpoint color.

5. The method of claim 4, further comprising:

defining, via the controller, a midpoint step, wherein the midpoint step is approximately halfway between the first step and the last step.

6. The method of claim 4, wherein the path includes the midpoint color.

7. The method of claim 4, further comprising:

prior to receiving the selection of the mirror function, providing, via a display device, a preview bar showing the first step with the first color, the last step with the last color and the steps between the first step and the last step with the intermediary colors, wherein one of the steps between the first step and the last step shows the midpoint color.

8. The method of claim 1, further comprising:

after redefining the steps, providing, via a display device, a revised preview bar showing the first step with the first color, the midpoint step with the last color, the last step with the first color, and the steps between the first step and the midpoint step and the steps between the midpoint step and the last step with the intermediary colors.

9. The method of claim 1, further comprising:

after redefining the steps, providing, via the controller, control signals to the lighting fixtures so that the lighting fixture at the first location displays the first color, the lighting fixture at the midpoint location displays the last color, the lighting fixture at the last location displays the first color, and lighting fixtures at locations between the first location and the midpoint location and between the midpoint location and the last location display the intermediary colors.

10. A method for creating a lighting state for a plurality of lighting fixtures, comprising:

receiving, via one or more input devices, an ordered list of colors, wherein the ordered list of colors includes a first color and a last color;

defining, via a controller, a plurality of steps wherein each step is associated with one of the plurality of lighting fixtures, wherein the steps includes a first step associated with the first color and a last step associated with the last color;

receiving, via the one or more input devices, a selection of a mirror function;

redefining, via the controller, the steps so that the first step and the last step are associated with the first color and a midpoint step is associated with the last color; and determining, via the controller, intermediary colors for steps between the first step and the midpoint step and steps between the midpoint step and the last step, wherein the intermediary colors for the steps between the first step and the midpoint step correspond to colors between the first color and the last color in a color space and the intermediary colors for the steps between the midpoint step and the last step mirror the intermediary colors between the first step and the midpoint step.

11. The method of claim 10, further comprising:

providing, via a display device, a preview bar showing the first step and the last step with the first color, the midpoint step with the last color, the steps between the first step and the midpoint step with the intermediary colors, and the steps between the midpoint step and the last step with the intermediary colors in a reverse order from an order between the first step and the midpoint step.

12. The method of claim 10, further comprising:

assigning, via the controller, the color associated with the first step to a lighting fixture at a first location, the color associated with the midpoint step to a lighting fixture at a midpoint location, and the color associated with the last step to a lighting fixture at a last location; and controlling, via the controller, the lighting fixtures so that the lighting fixture at the first location displays the first color, the lighting fixture at the midpoint location displays the last color, the lighting fixture at the last location displays the first color, and lighting fixtures at locations between the first location and the midpoint location and locations between the midpoint location and the last location display the intermediary colors.

13. The method of claim 10, wherein determining, via the controller, intermediary colors for steps between the first step and the midpoint step and steps between the midpoint step and the last step, comprises:

determining a path from the first color to the last color through the color space and selecting a number of approximately evenly spaced points along the path, wherein the number of points corresponds to the number of steps between the first step and the midpoint step.

14. The method of claim 10, wherein determining, via the controller, intermediary colors for steps between the first step and the midpoint step and steps between the midpoint step and the last step, comprises:

determining a frequency associated with the first color and determining a frequency associated with the last color; and selecting a number of approximately evenly spaced frequencies between the frequency for the first color and the frequency for the last color, wherein the number of frequencies corresponds to the number of steps between the first step and the midpoint step.

15. The method of claim 10, wherein determining, via the controller, intermediary colors for steps between the first step and the midpoint step and steps between the midpoint step and the last step, comprises:

determining a wavelength associated with the first color and determining a wavelength associated with the last color; and selecting a number of approximately evenly spaced wavelengths between the wavelength for the first color and the wavelength for the last color, wherein the number of wavelengths corresponds to the number of steps between the first step and the midpoint step.

* * * * *